United States Patent [19]

Moranne

[11] 4,231,424

[45] Nov. 4, 1980

[54] HEADER CONSTITUTING A PRESSURIZING TANK

[75] Inventor: Jean-Pierre Moranne, Franconville, France

[73] Assignee: Societe Anonyme des Usines Chausson, Asnieres, France

[21] Appl. No.: 917,859

[22] Filed: Jun. 23, 1978

[30] Foreign Application Priority Data

Jun. 22, 1977 [FR] France ..... 77 19102

[51] Int. Cl.[3] ..... F28B 9/10; F28F 13/06

[52] U.S. Cl. ..... 165/107 D; 123/41.27; 123/41.54; 165/108; 165/114; 165/174; 165/DIG. 24

[58] Field of Search ..... 123/41.54, 41.27; 165/108, 114, 174, 107 D, DIG. 24

[56] References Cited

U.S. PATENT DOCUMENTS

| | | | |
|---|---|---|---|
| 1,630,069 | 5/1927 | Muir | 123/41.54 |
| 1,646,070 | 10/1927 | Smith | 123/41.27 |
| 2,343,145 | 2/1944 | Heiney | 165/110 |
| 3,989,103 | 11/1976 | Cieszko et al. | 123/41.54 |
| 4,130,159 | 12/1978 | Ohta et al. | 123/41.54 |

FOREIGN PATENT DOCUMENTS

| | | | |
|---|---|---|---|
| 1128705 | 4/1962 | Fed. Rep. of Germany | 165/114 |

*Primary Examiner*—Sheldon Richter
*Attorney, Agent, or Firm*—Browdy and Neimark

[57] ABSTRACT

The header delimits a bearing portion 14 against which abuts a partition connected to the inner wall of the header by a gasket 17. A pipe for supplying the liquid to be cooled arrives beneath the partition 8 and a degassing duct 24 arrives above the partition in a compartment closed by a stopper.

15 Claims, 8 Drawing Figures

HEADER CONSTITUTING A PRESSURIZING TANK

The present invention relates to cooling circuits and more particularly to cooling circuits for Diesel engines, for it is well known that it is these circuits which are the most difficult to carry out. Actually, the amount of heat to get rid of in the case of a Diesel engine is greater than in the case of a petrol engine and it must be foreseen that it will often be necessary to provide for larger quantities of water than in the cooling circuits of the latter engines.

The amounts of water needed as well as the working temperatures create certain problems and in particular it is usual that cavitation phenomena are produced at the inlet of the water pump of the circuit.

In order to remedy this disadvantage it has already been suggested that the cooling circuits be provided with tanks containing a certain amount of liquid and to place these tanks in such a way that they can ensure that there is a permanent loading of the inlet of the water pump.

The present invention enables to obtain the same result without the use of an independent tank and, consequently, without the need for providing fastening means inside the engine compartment, or special tubing for bringing the liquid to the tank, and yet providing at the same time that the circuit is degassed without supplementary means.

According to the invention, the upper header of the heat exchanger of the cooling circuit comprises an inside partition which divides it into two compartments of which one is connected by a tubing to a circuit for bringing the liquid which is to be cooled as well as to the cooling tubes, and of which the other, situated on the upper part of the header, is connected through pressurizing tubing to the inlet of a pump for circulating the cooling liquid of an engine.

Several other features of the present invention can be seen besides from the detailed description which follows.

Various embodiments of the invention are shown by way of non-limitative examples in the accompanying drawings in which.

Figure 1:
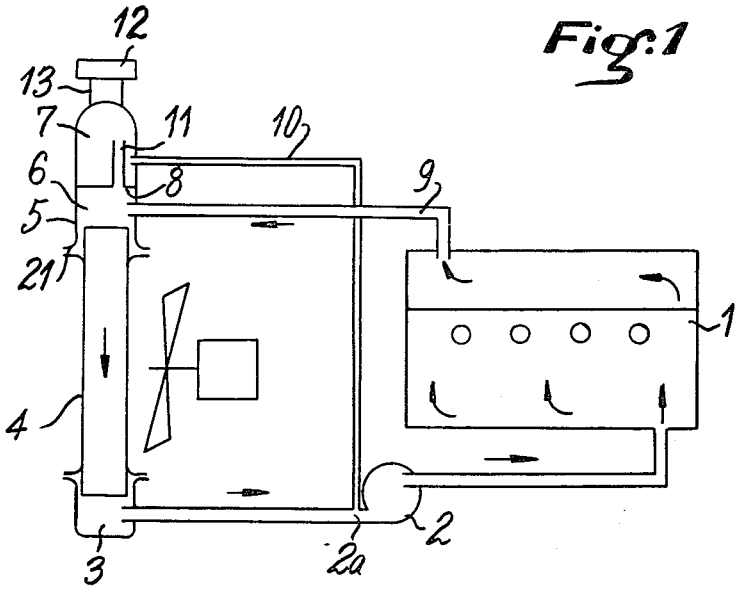
FIG. 1 is a diagram of a cooling circuit for Diesel engines embodying the invention.

In the drawings, reference number 1 designates a Diesel engine cooled by a liquid placed into circulation inside the engine jackets by a pump 2. The inlet of the pump 2 is connected in a known manner to the lower header 3 of a cooling heat exchanger 4, to the upper header 5 to which the jackets of the engine 1 are connected so that a circulation is created following the direction indicated by the arrows.

According to the invention, the upper header 5 is so constituted that it forms two compartments 6, 7 isolated one from the other by a partition 8. Compartment 6 is the one that is connected by a pipe 9 to the upper part of the engine jackets, while compartment 7 constitutes a tank and is connected by a pressurizing tubing 10 to the inlet 2*a* of the water pump 2.

The tubing 10 may be of small diameter because circulation does not really take place through this tube which is essentially provided to pressurize sufficiently the liquid pressure at the inlet of the pump 2 to prevent cavitation phenomena.

The compartment 7 of the header 5 being situaded on the upper part of the cooling circuit of the engine, it is an advantage, as shown in the drawing, to provide the partition 8 with a degassing tubing 11 of a very small useful diameter, so that the air or any other gas contained in the cooling circuit may be concentrated in the upper part of the compartment 7 which, in addition, can be used as a compartment for refilling the circuit; in which case, a stopper 12 provided with a pressure valve and a vacuum valve is mounted on a filling tube 13 of the header 5.

Figure 2:
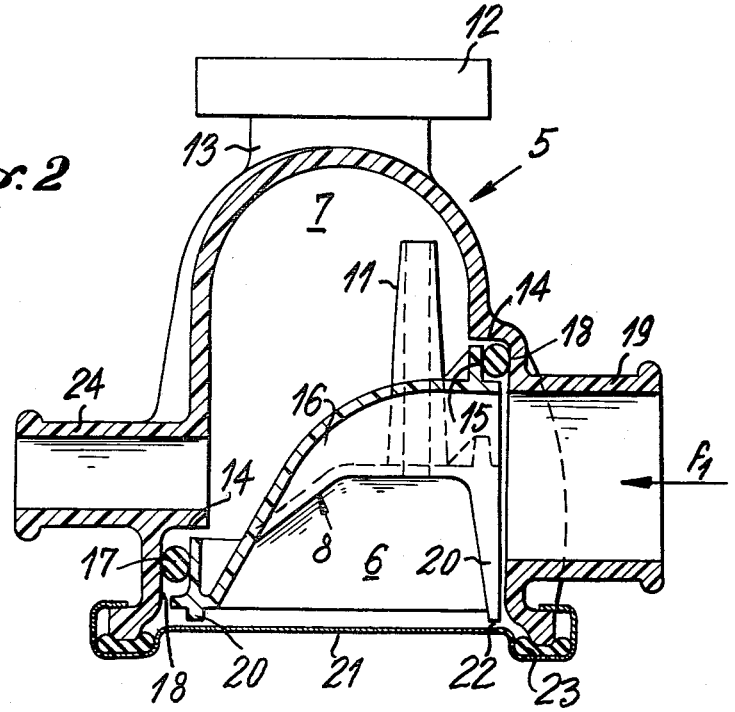
FIG. 2 is a cross-section of a particular embodiment of a header which comprises the heat exchanger shown in FIG. 1 for carrying out the invention.

In the embodiment of FIG. 2 the header is manufactured out of mouldable material, for instance of synthetic material, particularly plastic material, and this header forms inside a peripheral shoulder 14 making up a bearing portion for a raising peripheral edge 15 of the partition 8 which delimits a housing for a ring-shaped flexible gasket 17 which is fastened to a bearing portion 18 which delimits the inner surface of the header under the peripheral shoulder 14.

As shown in the drawing, the partition is so made that the volume of the upper compartment 7 may be as big as possible but it delimits as embossment 16 facing a tubing 19 to which the pipe coming from the jackets of the engine 1 is connected so that the liquid circulating in the direction of the arrow fl may lose only a small load when entering the header from below the partition 8.

The partition 8 shows, from below, some legs or braces 20 designed possibly to bear on the upper tube-plate 21 of the heat exchanger 4. There is an arrangement however between the lower part of the legs 20 and the upper portion of the tube-plate 21 as shown at 22 so that said legs may not constitute a hindrance for crushing a watertight gasket 23 which has to be placed between the header 5 and said tube-plate.

A second tubing 24 is provided in the header to arrive above the partition 8 and this second tubing is used for mounting the pressurizing connecting piping 10.

Positioning the partition 8 at the moment the heat exchanger is being assembled does not create any problems as it is enough to introduce said partition, no special care being needed, so that the gasket 17 be tightened between the edge 15 and the bearing portion 18, when the engine 1 rotates quickly, it usually happens that the liquid which is to be cooled is brought at a relatively high speed by the tubing 19. The drawing shows that the edge 15 can bear against the inner peripheral shoulder 14 of the header 5 and, consequently, there is no risk that the partition 8 may turn upside down inside the header.

The degassing tubing 11 reaches the upper part of the compartment 7 so that the amount of liquid in this compartment be as large as possible and so that it always may form in this manner a tank which will maintain pressurized the inlet of the pump 2.

Figure 3:
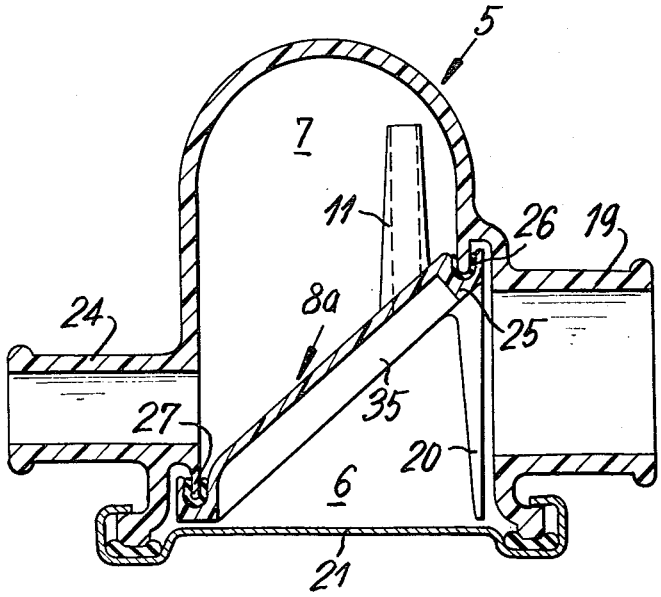
FIGS. 3 to 6 are cross-sections similar to those in FIG. 2 showing different embodiments of the invention.

FIG. 3 shows a variation according to which the partition designated by 8*a* is substantially even and presents, on the periphery a spout 25 in which is housed a gasket 26 which, sectionally, takes the form of the letter U, which gasket surrounds a peripheral rib 27 formed on the header. As previously, there is provision for legs-braces 20, which come from the partition 8*a* for possibly resting on the tube-plate 21.

Figure 4:
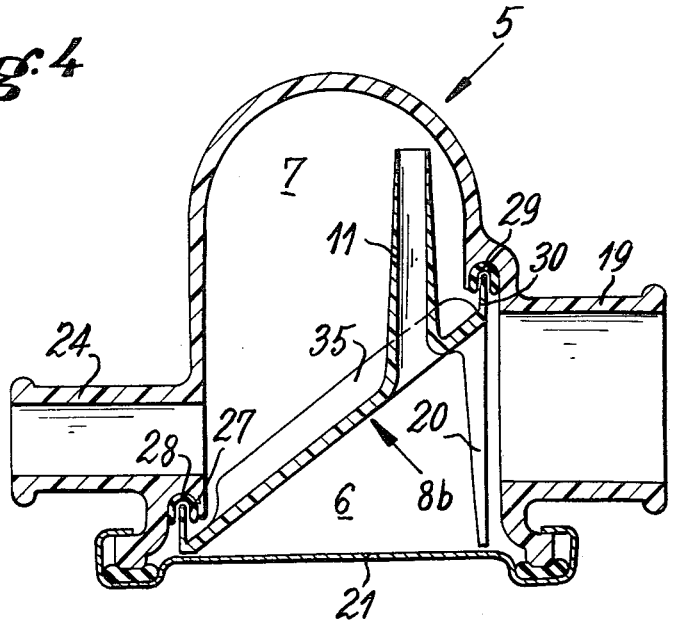

FIG. 4 shows a modification of the embodiment according to FIG. 3 according to which modification the groove 28 which is formed around the rib 27 is used for housing in it a gasket 29 and a turned-down edge 30 made up by the partition which is then designated as 8*b*.

The ribs 55 are preferably formed by the partition as shown in FIGS. 3 and 4 in order to prevent all kinds of deformation due to differences in the pressure exerted on either side of the partition.

Figure 5:
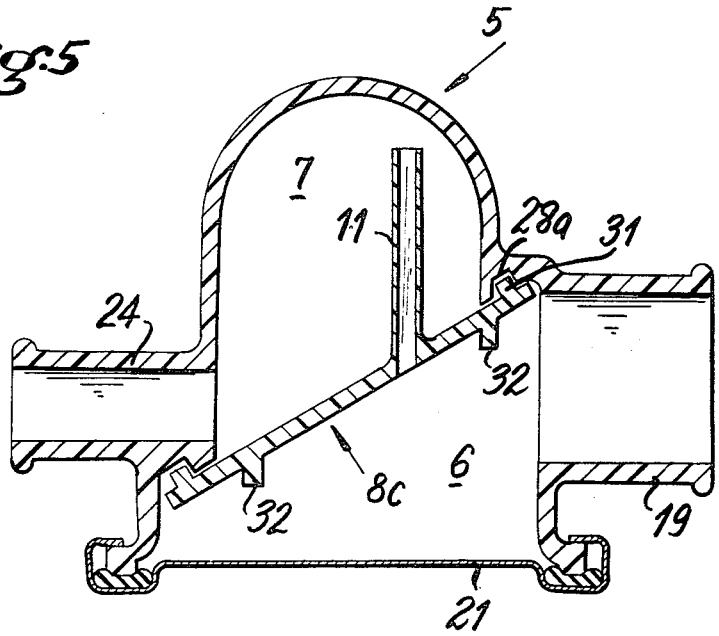

The partition may be manufactured out of the same material of which is manufactured the header 5, for example these two parts may be manufactured out of a polymer of polyphenylen oxyd, known by the trade mark "Noryl" and, in that case, it is an advantage, as shown in FIG. 5, to constitute the header 5 and the partition, shown then as 8*c*, in order that these parts can be fixed together for instance by applying ultrasounds.

If the header and the partition are made of other materials, for example of polyamid, then their junction by soldering can be secured by applying ultrasounds.

Figure 6:
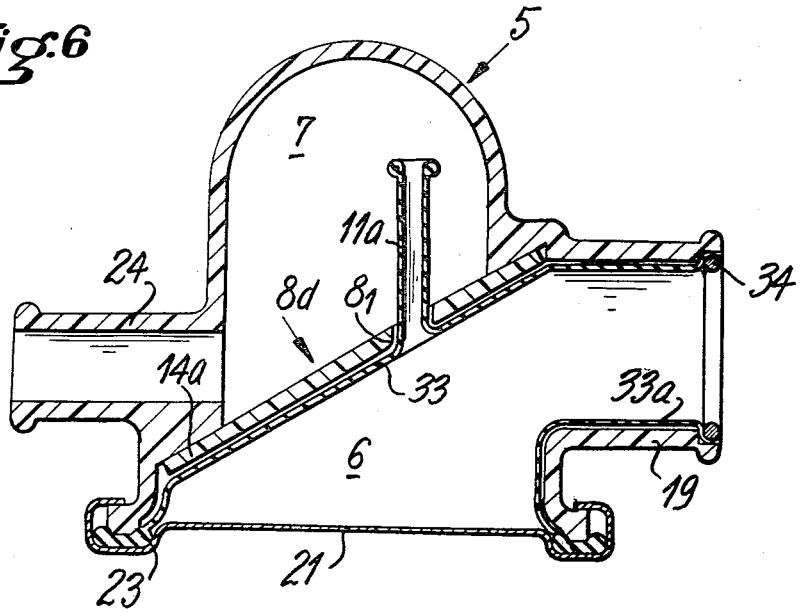

FIG. 6 shows another variation according to which the partition, shown then as 8*d*, is made up of a simple plate or grid which takes support on the peripheral shoulder 14*a* formed inside the header 5. In this embodiment, in order to provide watertightness between the partition 8*d* and the header, the gasket 23 which provides the watertightness between the header 5 and the tube-plate 21 is made up of a membrane 33 which covers all the surface of the partition 8*d* which faces the tube-plate. The membrane 33 forms the degassing tubing 11*a* going through a hole $8_1$ of the partition 8*d*. Furthermore the membrane 33 forms a socket 33*a* which is wedged in the tubing 19 and is kept therein by means of an elastic keeper-ring or any other suitable element 34.

Figure 7:
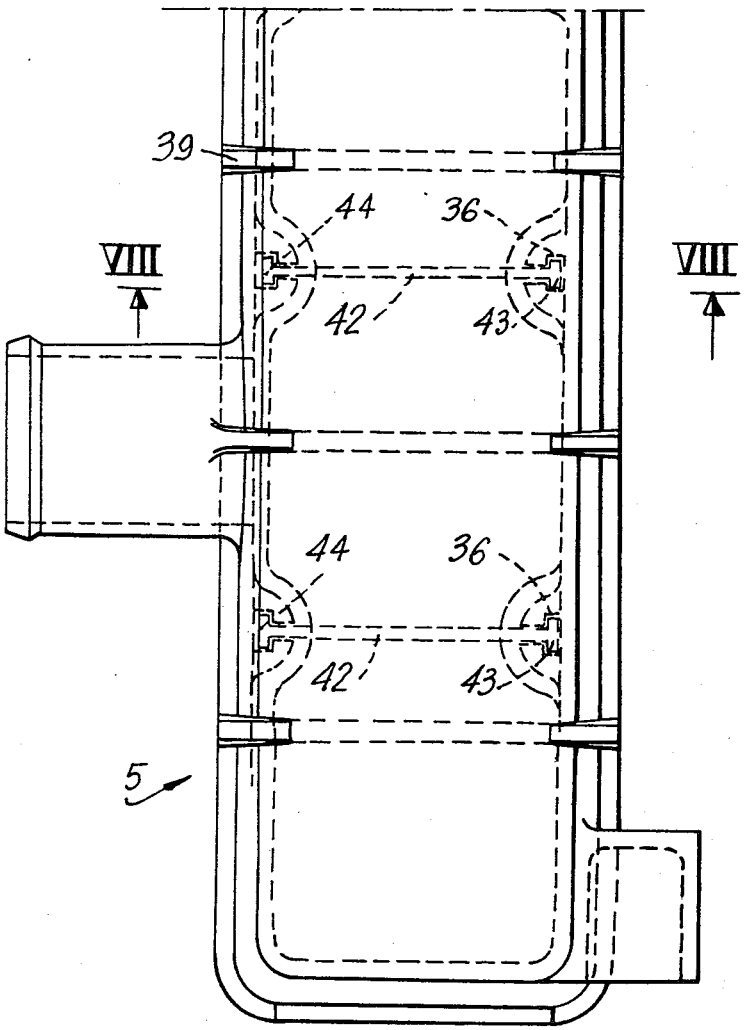
FIG. 7 is a partial plan-view of a header according to a modification.
Figure 8:
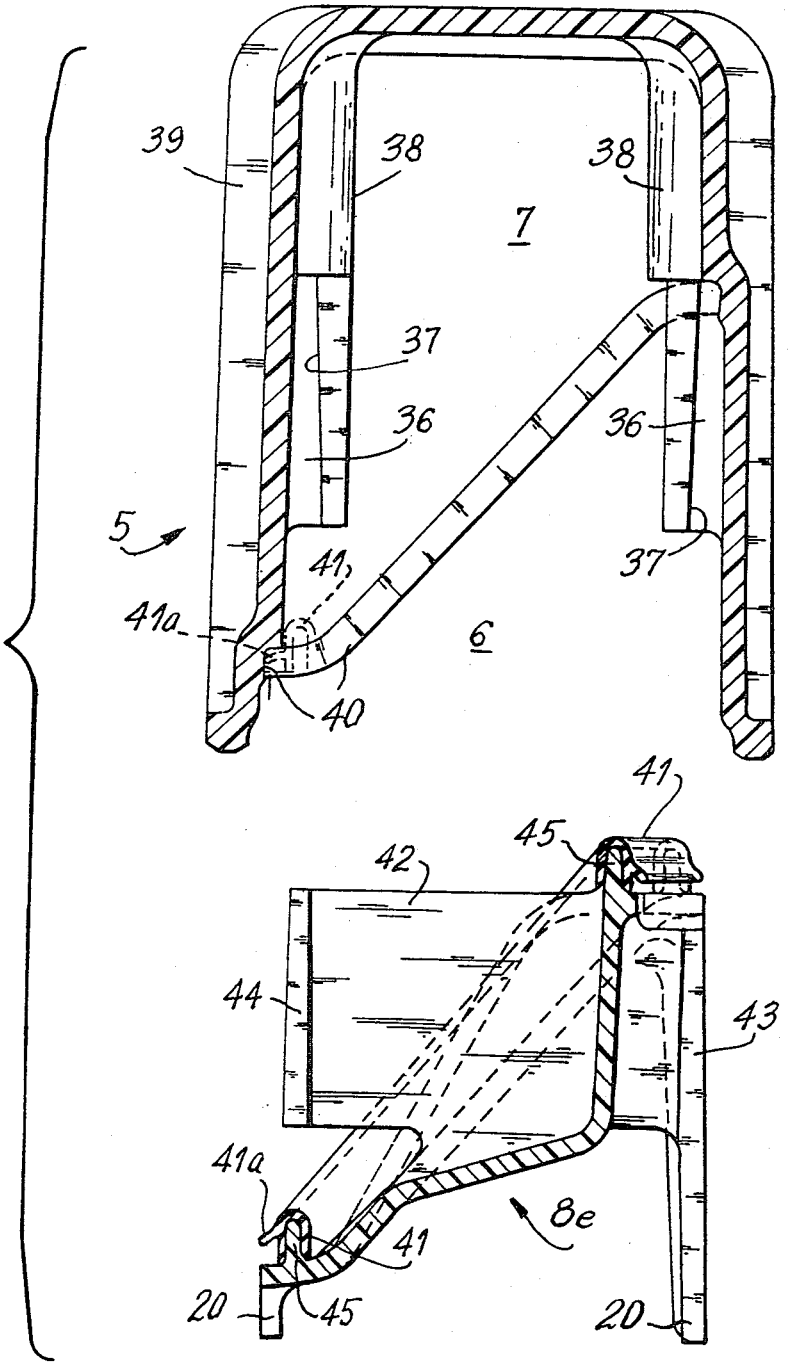
FIG. 8 is an exploded cross-section taken substantially along line VIII—VIII of FIG. 7.

In FIGS. 7 and 8 the partition 8*b* is provided to delimit two compartments 6 and 7 in the header 5.

The header has innerly and from place to place slides 36 formed from the two side walls of the header. The inner side of the slides has preferably a clearance shown as 37 in FIG. 8. Inner reinforcements 38 and outer reinforcements 39 are preferably also provided in the header made of moulding material.

A peripheral bearing 40 is formed all around the header in the inside wall for a deformable gasket 41 carried by the partition 8*e*.

As shown in FIGS. 7 and 8, the partition 8*e* comprises transverse walls 42 formed to correspond with the slides 36 of the header. The transverse walls 42 end by ribs 43, 44 of a shape corresponding to the slides and having as the slides a certain clearance so that the building arrangements may be compensated when the ribs 43, 44 are completely engaged in the slides 36. The partition has, near its periphery, a spurt 45 which is covered by the gasket 41. The gasket 41 has substantially the shape of a stirrup from one arm of which protrudes a wing 41*a* provided to bear against the side wall of the bearing portion 40 delimited in the header.

Legs 20 are provided in the partition 8*e* or possibly bearing on the tube-plate covered by the header 5.

The preceding disclosure shows that the partition 8*e* is perfectly stiffened by the transverse walls 42 and that firm connection is made between the partition 40 and the header by an encasing made by the ribs 43, 44 and the slides 36, while watertightness is perfectly ensured by means of the gasket 41.

Therefore, important pressure differences can exist between the compartments 6 and 7 without resulting in any deformation risk both of the header and the partition.

The present invention is not restricted to the embodiments shown and described in detail, since several modifications thereof may be carried out without departing from the scope of the invention as shown in the dependant claims. In particular, all or a part of the headers and partitions hereinabove described can be made of castings of metals or suitable alloys, particularly aluminium alloys or alloys of aluminium and zinc. It is also possible to make the headers and partitions by stamping and to crimp the partitions in the headers.

What we claim is:

1. A header forming a pressurized tank comprising:

a peripheral shoulder;

inside partition means dividing the header into a first compartment and a second compartment, said second compartment being on upper part of the header and said inside partition means including edge cooperating with corresponding said peripherial shoulder of the header, said edge forming a stop preventing any pivoting of said partition inside the header; circuit means for bringing to the header a liquid to be cooled;

a pump for circulating the liquid;

a tubing connecting said first compartment to said circuit means; and a pressurizing tubing connecting said second compartment to inlet of the pump.

2. A header according to claim 1, comprising a tube of small section which ensures a communication between the upper part of the compartment connected to the circulation tubes and the upper part of the compartment connected to the pressurizing tubing, whereby the tubing constitutes a degassing pipe for the cooling circuit.

3. A header according to claim 1, wherein the compartment connected to the inlet of the pump by the pressurizing tubing is supplementary provided with a filling tube and a filling up stopper which comprises a pressure valve and a vacuum valve.

4. A header according to claim 1, wherein said peripheral shoulder of the header is provided for housing a ring shaped watertightening gasket fastened between the edge of said partition means and a corresponding bearing portion of the header.

5. A header according to claim 1, comprising legs-braces formed by the partition and extending to upper portion of the tube-plate an arrangement being provided between the end of said legs-braces and the upper portion of the tube-plate when the ring-shaped edge of the partition bears against the peripheral shoulder of the header.

6. A header according to claim 1, wherein the partition forms an embossment at right angles with inlet tubing of the header.

7. A header according to claim 1, wherein the partition forms a peripheral groove for housing a gasket tightened on a rib of the header.

8. A header according to claim 1, delimiting an inner peripheral groove for housing a gasket and a peripheral edge formed by the partition.

9. A header according to claim 1, wherein the header and the partition are manufactured of synthetic material of same nature and are connected by linear vibration, ultrasounds or any similar process.

10. A header according to claim 1, comprising a peripheral bearing portion for a watertightness gasket carried by the partition.

11. A header forming a pressurizing tank comprising an inside partition which divides it into two compartments of which one is connected by tubing to a circuit for bringing the liquid which is to the cooled as well as to the cooling tubes, and of which the other, situated on the upper part of the header, is connected through pressurizing tubing to the inlet of a pump for circulating the cooling liquid of an engine, and wherein the partition comprises stiffening transverse walls formed from place to place and which are connected to retaining elements provided in the header.

12. A header according to claim 11, delimiting from place to place slides, the stiffening transverse walls of the partition having ribs engaged in the said slides.

13. A header according to claim 12, wherein the slides of the header and the ribs of the stiffening walls of the partition have a complementary clearance for compensating the mounting arrangements.

14. A header forming a pressurizing tank comprising an inside partition which divides it into two compartments of which one is connected by a tubing circuit for bringing the liquid which is to the cooled as well as to the cooling tubes, and of which the other, situated on the upper part of the header, is connected through pressurizing tubing to the inlet of a pump for circulating the cooling liquid of an engine, and wherein the partition is constituted by a plate of grid forming a support for a membrane which extends from a gasket ensuring watertightness between the header and the corresponding tubeplate, said membrane also forming a sheath placed inside the inlet tubing of said header, a keeper-ring or similar fastening element being provided to retain said sheath.

15. A header forming a pressurizing tank comprising an inside partition which divides it into two compartments of which one is connected by a tubing to a circuit for bringing the liquid which is to the cooled as well as to the cooling tubes, and of which the other, situated on the upper part of the header, is connected through pressurizing tubing to the inlet of a pump for circulating the cooling liquid of an engine, a peripheral bearing portion for a watertightness gasket carried by the partition, and a peripheral spurt formed by the partition for receiving the watertightness gasket, said gasket having the shape of a stirrup from one arm of which protrudes a wing which bears against the peripheral bearing portion of the header.

* * * * *

UNITED STATES PATENT AND TRADEMARK OFFICE

CERTIFICATE OF CORRECTION

PATENT NO. : 4,231,424

DATED : November 4, 1980

INVENTOR(S) : Jean-Pierre MORANNE

It is certified that error appears in the above-identified patent and that said Letters Patent are hereby corrected as shown below:

Claim 11, line 4, "to the cooled" should read --to be cooled--

Claim 14, line 4, "to the cooled" should read --to be cooled-- line 9, "plate of grid" should read --plate or grid--

Claim 15, line 4, "to the cooled" should read --to be cooled--

Signed and Sealed this

*Twenty-fourth* Day of *March 1981*

[SEAL]

*Attest:*

RENE D. TEGTMEYER

*Attesting Officer*

*Acting Commissioner of Patents and Trademarks*